United States Patent [19]

Pourtau et al.

[11] Patent Number: 5,040,521

[45] Date of Patent: Aug. 20, 1991

[54] MACHINE FOR CUTTING TILES, PARTICULARLY SANDSTONE ONES

[75] Inventors: Jean-Jacques Pourtau, Croissy sur Seine; Abel Thiriet, Dole, both of France

[73] Assignee: Tomecanic, France

[21] Appl. No.: 490,121

[22] Filed: Mar. 6, 1990

[30] Foreign Application Priority Data

Mar. 7, 1989 [FR] France ..... 8902987

[51] Int. Cl.[5] ..... B28D 1/22

[52] U.S. Cl. ..... 125/23.002; 225/96.005

[58] Field of Search ..... 125/23.02, 23.01; 225/96.5

[56] References Cited

U.S. PATENT DOCUMENTS

| | | | |
|---|---|---|---|
| 2,541,708 | 2/1951 | Marus | 125/23.02 |
| 3,889,862 | 6/1975 | Insolio | 225/96.5 |
| 4,922,886 | 5/1990 | Hepworth | 125/23.01 |

FOREIGN PATENT DOCUMENTS

| | | |
|---|---|---|
| 0216707 | 1/1987 | European Pat. Off. . |
| 1235792 | 3/1967 | Fed. Rep. of Germany . |
| 2902497 | 8/1979 | Fed. Rep. of Germany . |
| 2490541 | 3/1982 | France . |

*Primary Examiner*—Hien H. Phan

*Attorney, Agent, or Firm*—Skjerven, Morrill, MacPherson, Franklin & Friel

[57] ABSTRACT

This invention relates to a machine for cutting tiles, particularly sandstone ones, comprising: a guide rail; a cutting assembly mounted to move along said guide rail, guided by this guide rail and provided with a cutting tool; and a member for breaking the tile after scoring, which comprises two bearings flanges, which is mounted to be adjustable in position with respect to said cutting assembly and which may occupy two positions: a first position, in which the bearing flanges do not bear on the surface of the tile to be broken, and a second position in which, on the contrary, said bearing flanges are in contact with the surface of the tile to be broken, on either side of a longitudinal plane of the cutting assembly passing through the cutting tool and are in such abutment on the surface of the tile as to cause said tile to break. According to the invention, the breaking member is mounted on the cutting assembly itself. One application is the production of a machine making good-quality cuts.

8 Claims, 5 Drawing Sheets

MACHINE FOR CUTTING TILES, PARTICULARLY SANDSTONE ONES

FIELD OF THE INVENTION

The present invention relates to a machine for cutting tiles, particularly sandstone ones.

BACKGROUND OF THE INVENTION

Machines for cutting sandstone tiles or the like are known, comprising: a guide rail; a cutting assembly mounted to move along said guide rail, guided by this guide rail and provided with a cutting tool; and a member for breaking the tile after scoring, which comprises two bearing flanges, which is mounted to be adjustable in position with respect to said cutting assembly and which may occupy two positions, a first position, in which the bearing flanges do not bear on the surface of the tile to be broken, and a second position in which, on the contrary, said bearing flanges are in contact with the surface of the tile to be broken, on either side of a longitudinal plane of the cutting assembly passing through the cutting tool and are in such abutment on the surface of the tile as to cause said tile to break.

Patent FR-A-2 490 541 discloses such a machine.

However, it may be observed hat, in the known machines, the breaking member is mounted on the frame itself of the machine, and not on the cutting assembly. The operation of breaking the tile is consequently effected at one end of the score, to some extent in at least partial overhang, and may lead to tiles not being satisfactorily cut.

SUMMARY OF THE INVENTION

It is an object of the invention to overcome this drawback by providing to that end mounting the breaking member on the cutting assembly itself.

The following advantageous arrangements are also preferably adopted:

- the breaking member is mounted to pivot with respect to the cutting assembly about a transverse axis perpendicular to said longitudinal plane;
- in the second position, the whole of the cutting tool is disposed above and out of contact with the surface of the tile to be broken;
- the breaking member is generally U-shaped and is mounted on said cutting assembly via the two parallel arms of the U, whilst the web joining said parallel arms of the U constitutes a handle for maneuvering this breaking member;
- this machine comprises two arms which extend parallel to said longitudinal plane, on either side of this longitudinal plane, and which are bent, at one of their respective ends, into extensions extending perpendicularly to said longitudinal plane and constituting said bearing flanges;
- in said second position, the breaking member takes reaction abutment on the guide rail;
- in this second position, the breaking member takes reaction abutment on the guide rail via the cutting assembly, on which it is mounted;
- the breaking member is provided with a means for adjusting its position, whilst the cutting assembly is itself provided with a lever for controlling the scoring abutment of the cutting tool on the surface of a tile to be broken, which is distinct from said member for adjusting the position of the breaking member and which also constitutes the member for controlling abutment of said bearing flanges on said surface of the tile, which flange abutment is capable of causing said tile to break.

The principal advantage of a machine according to the invention lies in its ability, as soon as a tile has been scored, to effect break thereof by abutment of the bearing flanges at the optimum place for obtaining a satisfactory cut, and consequently in the elimination of the poor-quality cuts obtained by adopting prior known techniques, this, in addition, in nonproductive time.

Moreover, such break is effected in even more satisfactory manner when the cutting tool is not in contact with the surface of the tile during the breaking operation.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
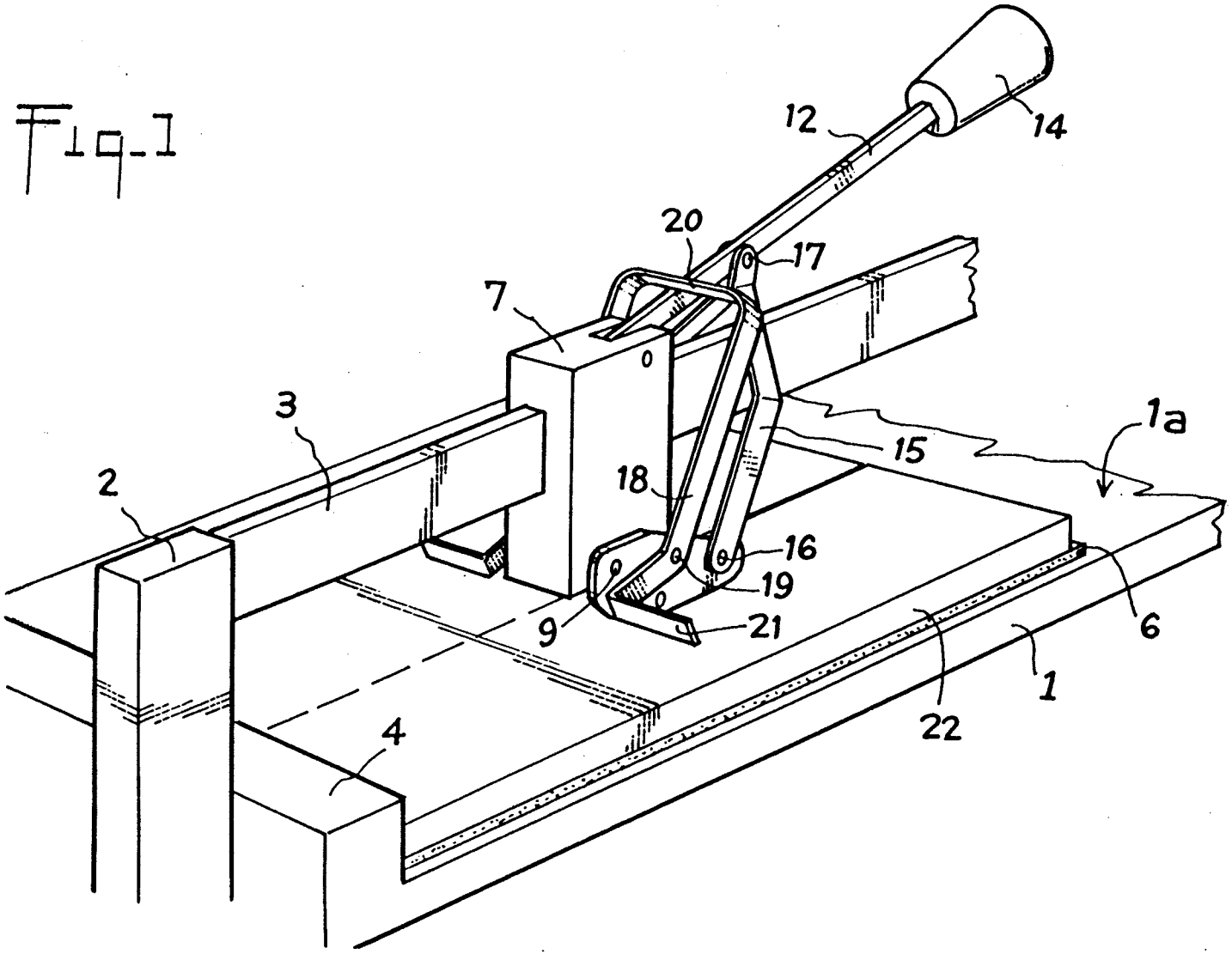
FIG. 1 is a perspective view of a machine according to the invention in a first configuration of use.

Referring now to the drawings, the machine according to the invention is constituted by:

- a lower base 1, disposed horizontally;
- a vertical column 2, upstanding from the base 1 and integral therewith;
- a guide rail 3 which extends horizontally, above the base 1, which is of rectangular section and which is supported by column 2;
- a stop 4 for blocking the tile to be cut, which extends transversely and horizontally, perpendicularly to the vertical longitudinal plane P (FIG. 5) passing through the center of the transverse section of the guide rail 3;
- a protuberance 5, of hemispherical transverse section of small diameter, whose axis 5*a* is contained in the longitudinal plane P, and which is in one piece with the base 1;
- an elastomer plate 6 of small thickness, covering the upper face 1*a* of the base 1, as well as said protuberance 5;
- a slide block 7 which comprises a through cavity of rectangular section defined by an inner upper face 7*a* and an inner lower face 7*b* and by two sides, for sliding assembly on the guide rail 3, the rectangular sections of said guide rail and said cavity being equal to within the clearance allowing said slide;
- a lower rocker member 8 which is mounted to pivot on the slide block 7, on the lower part thereof, about an axis 9 perpendicular to the longitudinal plane P, and on which is rotatably mounted about a transverse axis 10 a knurl 11 for scoring, located in the longitudinal plane P and constituting the cutting tool of the machine;
- a lever 12 for controlling slide of the slide block 7, which is articulated on said slide block about an axis 13 (FIG. 2) located in the upper part of the slide block, above the guide rail 3, and perpendicular (axis 13) to the longitudinal plane P;

a maneuvering handle 14 located at the free end of the lever 12;

a connecting rod 15 which connects the rocker member 8 to the lever 12 by means of two pivot pins 16 and 17, respectively, both perpendicular to the longitudinal plane P, the pivot pin 16 on the rocker member 8 being disposed beyond the axis of rotation 10 of the knurl 11 with respect to the pivot axis 9 of said rocker member;

a generally U-shaped bow element of which the two parallel arms 18 extend parallel to the longitudinal plane P, being articulated in their lower parts on the rocker member 8 about axes 19 perpendicular to the longitudinal plane P, the transverse bar 20 of the U, which connects the arms 18 at their upper ends, constituting a handle for maneuvering the bow, adapted to adjust the pivoting thereof, and arms 18 extending, at their lower ends, in parts bent at 90° , which extend perpendicularly to the longitudinal plane P, moving away from this longitudinal plane and constituting two bearing flanges 21 disposed symmetrically with respect to the longitudinal plane P.

A sandstone tile 22 rests on the elastomer plate 6, having an edge **22*a* in abutment against the stop 4, and its upper face 22*b* being oriented upwardly, opposite the knurl 11**.

Figure 2:
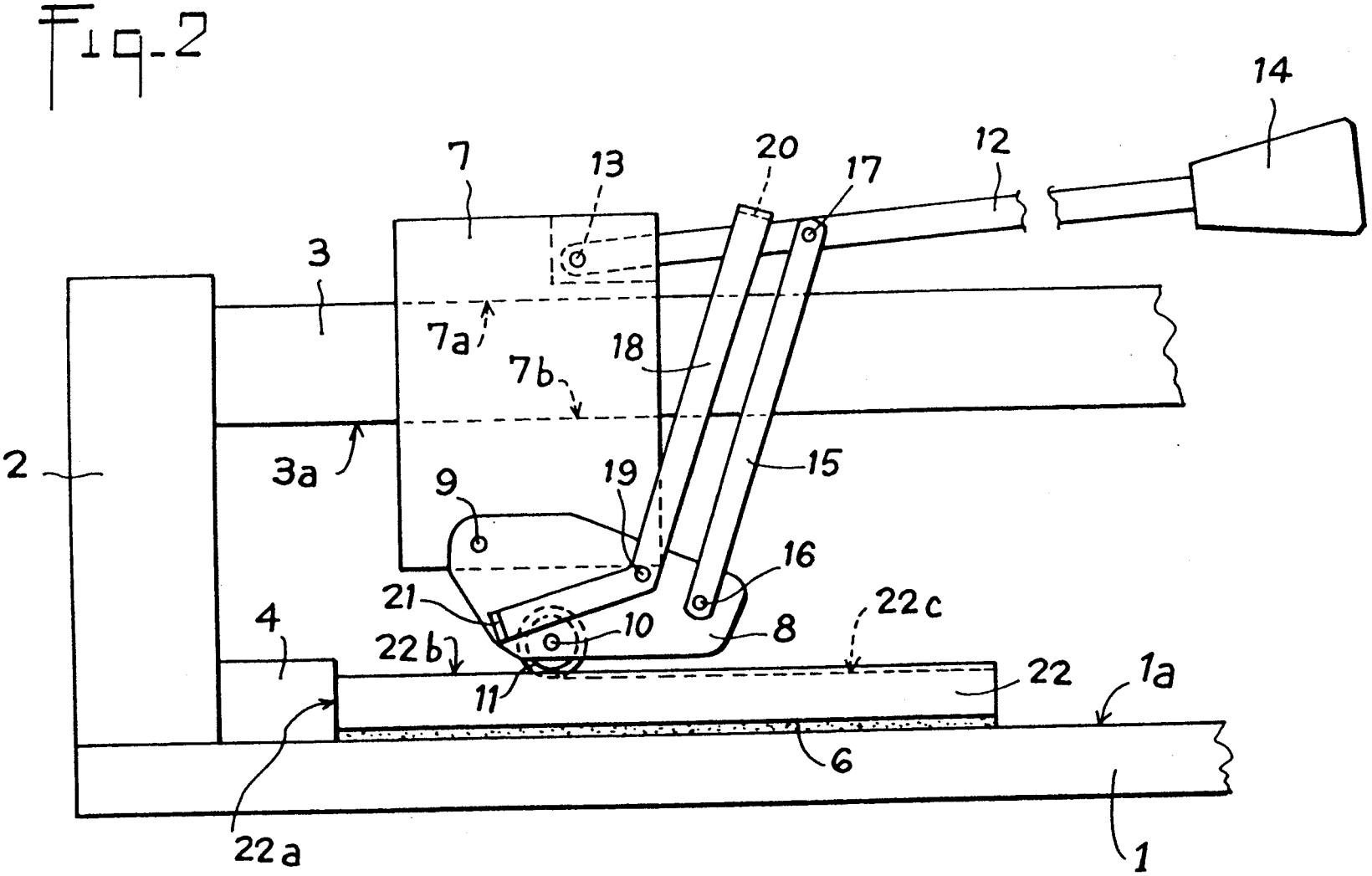
FIG. 2 is a view in elevation of the machine of FIG. 1.

FIGS. 1 and 2 illustrate the phase of scoring of the upper face **22*b* by the knurl 11 and the making of the score 22*c*. The operator presses on lever 12 by acting on handle 14, which results in transmitting a downward effort to the connecting rod 15. The inner lower surface 7*b* of the cavity of the slide block 7 comes into abutment on the lower horizontal face 3*a* of the guide rail 3, that part of the rocker member 8 associated with pivot pin 16 tends to pivot towards the upper face 22*b* of the tile 22 and the knurl 11 penetrates in said tile and traces a score 22*c* thereon, contained in the longitudinal plane P, under the effect of the displacement of the slide block 7 along the guide rail 3**.

It should be noted that the handle 20 for maneuvering the bow (18–20) is tipped towards handle 14 and, in that case, the bearing flanges 21 are disposed above the upper face **22*b*** of the tile, out of contact therewith.

Figure 3:
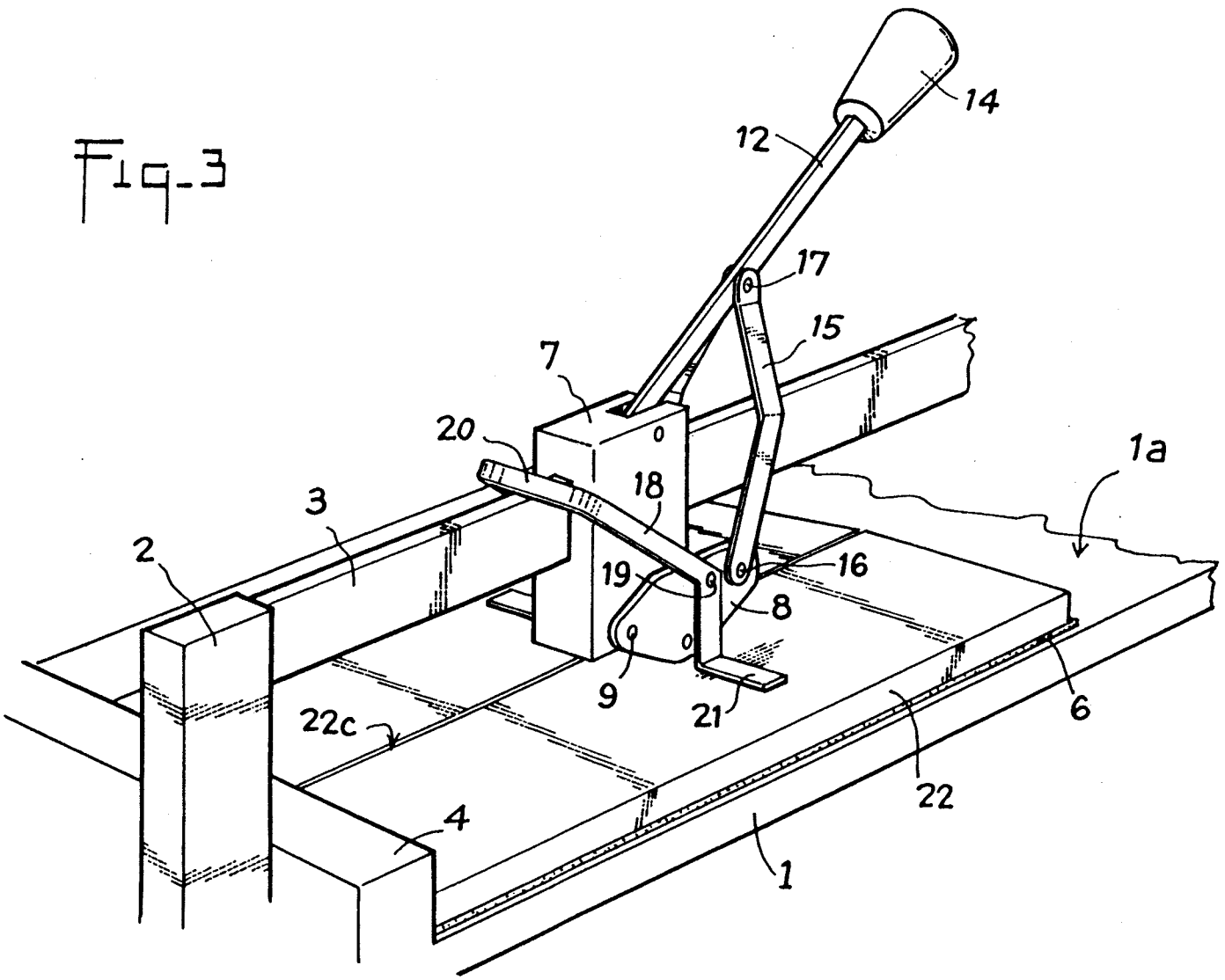
FIG. 3 is a perspective view of the machine of FIG. 1 in a second configuration of use.
Figure 4:
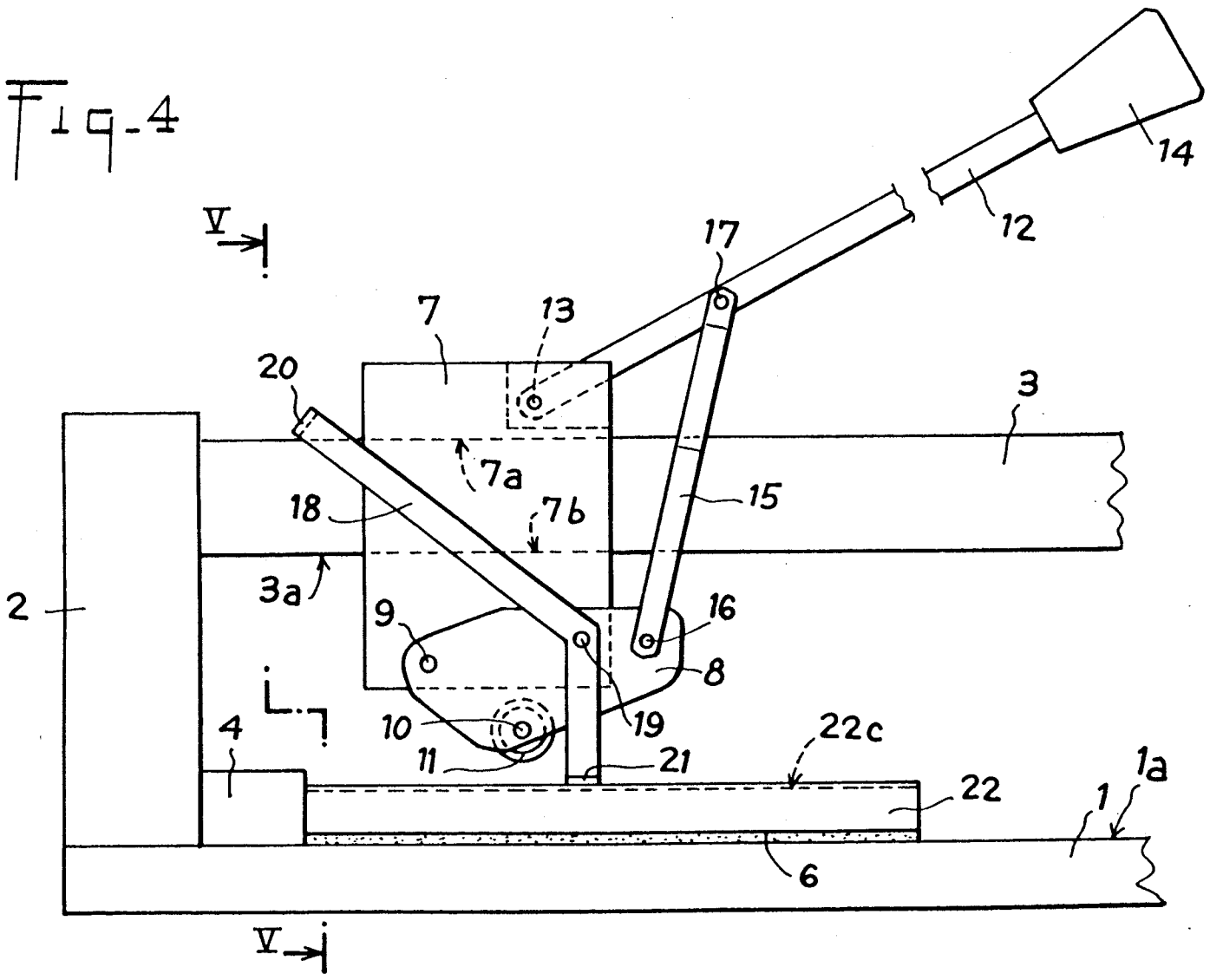
FIG. 4 is a view in elevation of the machine of FIG. 3.
Figure 5:
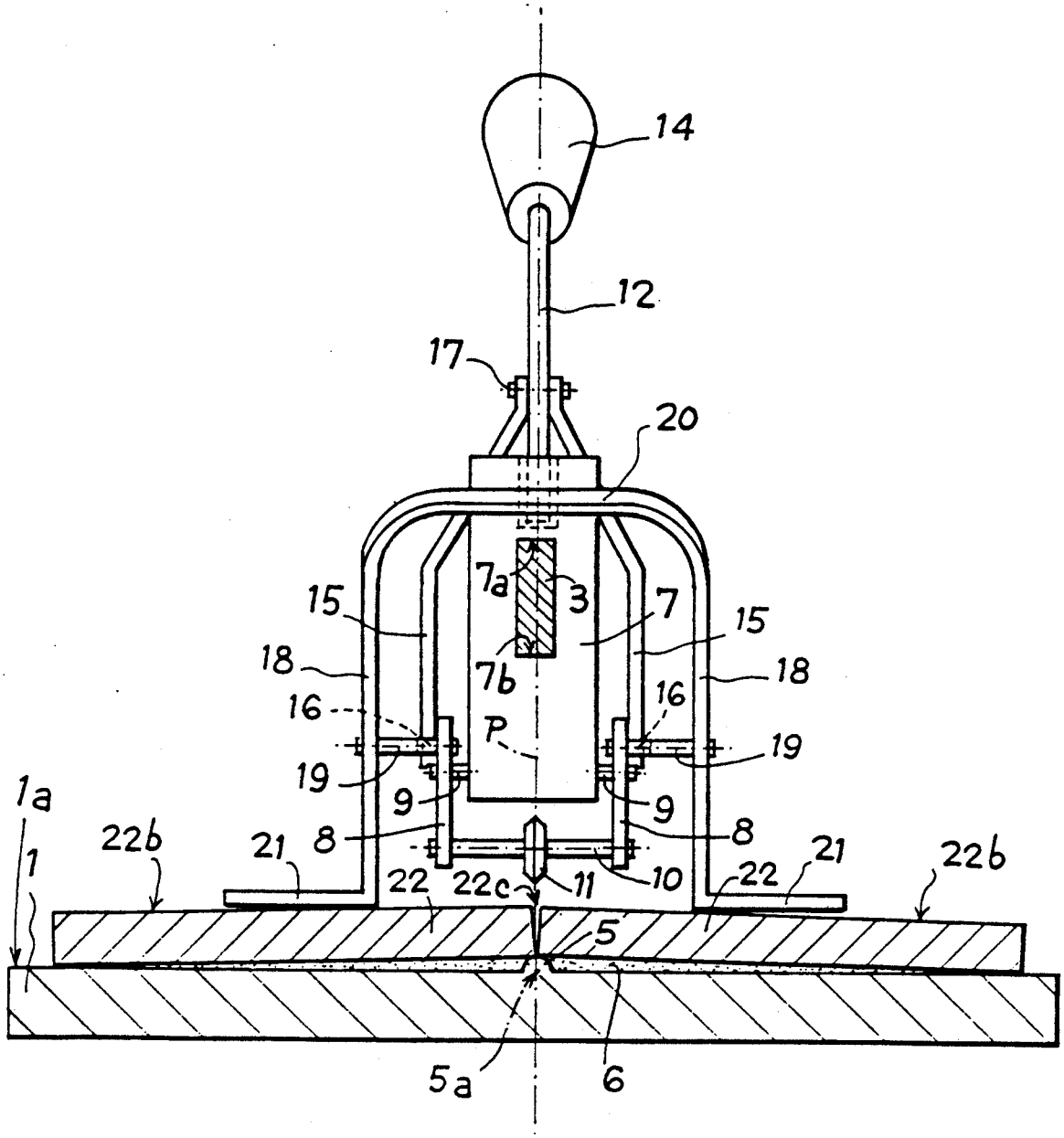
FIG. 5 is a section along V—V of FIG. 4.

FIGS. 3, 4 and 5 show the phase of breaking the tile, after the scoring phase is terminated.

From the configuration of FIGS. 1 and 2, the operator firstly releases handle 14 and momentarily stops exerting a downward effort on the rocker member 8. He pivots the bow, moving the web 20 of the U away from handle 14, which has for its effect, on the one hand, to place in abutment on face **22*b* of the tile the two bearing flanges 21, symmetrically with respect to the longitudinal plane P, on the other hand, to pivot the rocker member 8 about axis 9 and thus to move knurl 11 away from the upper face 22*b* of the tile, disposing the whole of this knurl well out of contact with said face 22*b*. In that case, the operator, nc longer touching the bow (18–20), takes the handle 14 again and exerts a further effort directed towards the upper face 22*b* of the tile which, via the rocker member 8 and the pivot pin 19, results in transmitting this effort to the bearing flanges 21. These latter, by bearing very strongly on the upper face 22*b* on either side of score 22*c*, cause the tile to break along score 22*c***.

The cut obtained is of good quality, as the operator can use his experience to place the bearing flanges 21 at the optimum spot, these flanges being precisely adjustable in position along the score **22*c*** previously made.

It should be noted that, during this phase, at no moment does the knurl 11 come into contact with the tile 22 and this tile can therefore be broken satisfactorily. There again, the inner lower face **7*b* of the cavity of the slide block 7 has come into abutment on the lower horizontal face 3*a* of the guide rail 3**.

The application of the invention is not limited to the machine described. Bearing flanges 21 which may be disposed with respect to face **22*b* of tile 22 and with respect to knurl 11 similarly to what has been described, combined with an effort-transmitting handle similar to handle 14**, symmetrical with respect to the longitudinal plane P, may be used with the same efficiency with the cutting machine described in U.S. Pat. No. FR-A-2 587 647. The invention is therefore not limited to the description of the embodiment shown, but covers, on the contrary, all the variants which may be made thereto without departing from its scope nor its spirit.

What is claimed is:

1. In a machine for cutting tiles, particularly sandstone ones, comprising:

a guide rail;

a cutting assembly mounted to move along said guide rail, guided by said rail and having means including a cutting tool for scoring a tile; and a breaking member mounted to said cutting assembly for breaking the tile after scoring, said breaking member comprising two bearing flanges, said flanges being mounted to be adjustable in position with respect to said cutting assembly and movable between a first position, in which the bearing flanges do not bear on the surface of the tile to be broken, and a second position, in which said bearing flanges are in abutment contact with the surface of the tile to be broken, on either side of a vertical plane of the cutting assembly passing through the cutting tool and are in said abutment contact on the surface of the tile as to cause said tile to break and wherein said breaking member is generally U-shaped and is mounted on said cutting assembly via two parallel arms of the U, and wherein a web joining said parallel arms of the U constitutes a handle for maneuvering said breaking member bearing flanges into said abutment contact.

2. The machine of claim 1, wherein the breaking member is mounted to pivot with respect to the cutting assembly about a transverse axis perpendicular to said vertical plane.

3. The machine of claim 1, wherein, in the second position, the cutting tool is disposed above and out of contact with the surface of the tile to be broken.

4. The machine of claim 1, wherein said two arms which extend in the same direction as said cutting tool extends from said cutting assembly and parallel to said vertical plane, on either side of said vertical plane, are bent at one of their respective ends, into extensions extending perpendicularly to said vertical plane and constituting said bearing flanges.

5. The machine of claim 1, wherein, in said second position, the breaking member takes reaction abutment on the guide rail.

6. The machine of claim 5, wherein, in said second position, the breaking member takes reaction abutment on the guide rail via the cutting assembly, on which it is mounted.

7. The machine of claim 1, wherein the breaking member includes means for adjusting the position of said bearing flanges, the cutting assembly including a lever for controlling the scoring abutment of the cutting tool on the surface of a tile to be broken, which is distinct from said member for adjusting the position of the bearing flanges and which also constitutes the member for controlling abutment of said bearing flanges on said surface of the tile, which flange abutment is capable of causing said tile to break.

8. The machine of claim 1 in which said cutting assembly includes pivotable rocker member mounting said cutting tool, an operating pivot handle and means for connecting said handle to said rocker member, downward movement of said handle affecting said scoring of the tile, and in which said breaking member is pivotably attached to said rocker member and which in said second position of said breaking member, movement of said handle exerts a tile breaking force on said breaking member.

* * * * *

UNITED STATES PATENT AND TRADEMARK OFFICE

CERTIFICATE OF CORRECTION

PATENT NO. : 5,040,521
DATED : August 20, 1991
INVENTOR(S) : Jean-Jacques Pourtau and Abel Thiriet

It is certified that error appears in the above-identified patent and that said Letters Patent is hereby corrected as shown below:

Col. 3, line 61, delete "nc" and insert --no--.

Col. 4, line 18, delete "U.S.".

Signed and Sealed this

Eighth Day of June, 1993

*Attest:*

Michael K. Kirk

MICHAEL K. KIRK

*Attesting Officer*

*Acting Commissioner of Patents and Trademarks*